US010035185B2

(12) United States Patent
Shah et al.

(10) Patent No.: US 10,035,185 B2
(45) Date of Patent: Jul. 31, 2018

(54) HYBRID TURBINE BLADE FOR IMPROVED ENGINE PERFORMANCE OR ARCHITECTURE

(71) Applicant: United Technologies Corporation, Hartford, CT (US)

(72) Inventors: Dilip M. Shah, Glastonbury, CT (US); Alan D. Cetel, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/651,911

(22) PCT Filed: Dec. 13, 2013

(86) PCT No.: PCT/US2013/074956

§ 371 (c)(1),
(2) Date: Jun. 12, 2015

(87) PCT Pub. No.: WO2014/133635

PCT Pub. Date: Sep. 4, 2014

(65) Prior Publication Data

US 2015/0321249 A1 Nov. 12, 2015

Related U.S. Application Data

(60) Provisional application No. 61/737,530, filed on Dec. 14, 2012.

(51) Int. Cl.
*B22D 25/02* (2006.01)
*B22D 19/16* (2006.01)
(Continued)

(52) U.S. Cl.
CPC ..... *B22D 25/02* (2013.01); *B22D 19/16* (2013.01); *B22D 21/025* (2013.01); *B22D 21/06* (2013.01);
(Continued)

(58) Field of Classification Search
CPC ..... C22C 19/057; B22D 25/02; B22D 19/16; B22D 21/025; B22D 27/045; F01D 5/14;
(Continued)

(56) References Cited

U.S. PATENT DOCUMENTS 2,479,039 A 8/1949 Cronstedt
3,394,918 A 7/1968 Wiseman
(Continued)

FOREIGN PATENT DOCUMENTS

EP 2692462 A2 2/2014
JP 2011137220 A 7/2011
(Continued)

OTHER PUBLICATIONS

European Search Report for EP Patent Application No. 13876615.9, dated Jun. 7, 2016.
(Continued)

*Primary Examiner* — Helene Klemanski
(74) *Attorney, Agent, or Firm* — Bachman & LaPointe, P.C.

(57) ABSTRACT

A method is provided for casting an article such as a blade having an attachment root and an airfoil, the airfoil having a proximal end and a distal end. The method comprises introducing a molten alloy into a mold; and varying a composition of the introduced alloy during the introduction so as to produce a compositional variation.

30 Claims, 5 Drawing Sheets

(51) Int. Cl.

| | |
|---|---|
| ***B22D 21/02*** | (2006.01) |
| ***B22D 27/04*** | (2006.01) |
| ***C22C 19/05*** | (2006.01) |
| ***F01D 5/14*** | (2006.01) |
| ***F01D 5/28*** | (2006.01) |
| ***B22D 21/06*** | (2006.01) |

(52) U.S. Cl.
CPC ..... *B22D 27/045* (2013.01); *C22C 19/057* (2013.01); *F01D 5/14* (2013.01); *F01D 5/147* (2013.01); *F01D 5/28* (2013.01); *F05D 2220/30* (2013.01); *F05D 2230/21* (2013.01); *F05D 2230/211* (2013.01); *F05D 2300/131* (2013.01); *F05D 2300/132* (2013.01); *F05D 2300/133* (2013.01); *F05D 2300/135* (2013.01); *F05D 2300/17* (2013.01); *F05D 2300/606* (2013.01); *F05D 2300/609* (2013.01); *Y10T 403/478* (2015.01)

(58) Field of Classification Search
CPC ..... F01D 5/147; F01D 5/28; F05D 2220/30; F05D 2230/21; F05D 2230/211
USPC ..... 420/445, 443
See application file for complete search history.

(56) References Cited

U.S. PATENT DOCUMENTS

| | | | |
|---|---|---|---|
| 3,847,203 | A | 11/1974 | Northwood |
| 4,008,052 | A | 2/1977 | Vishnevsky et al. |
| 4,377,196 | A | 3/1983 | Khandros |
| 4,869,645 | A | 9/1989 | Verpoort |
| 5,000,244 | A | 3/1991 | Osborne |
| 5,035,958 | A | 7/1991 | Jackson et al. |
| 5,100,484 | A | 3/1992 | Wukusick et al. |
| 5,409,781 | A | 4/1995 | Rosler et al. |
| 5,451,142 | A | 9/1995 | Cetel et al. |
| 5,558,150 | A | 9/1996 | Sponseller |
| 5,713,408 | A | 2/1998 | Morando |
| 6,074,602 | A | 6/2000 | Wukusick et al. |
| 6,419,763 | B1 | 7/2002 | Konter et al. |
| 6,872,912 | B1 | 3/2005 | Wos et al. |
| 7,037,079 | B2 | 5/2006 | Wettstein et al. |
| 7,065,872 | B2 | 6/2006 | Ganesh et al. |
| 7,231,955 | B1 | 6/2007 | Bullied et al. |
| 7,338,259 | B2 * | 3/2008 | Shah et al. ..... 416/241 R |
| 7,546,685 | B2 | 6/2009 | Ganesh et al. |
| 7,757,748 | B2 | 7/2010 | Shiraki et al. |
| 7,762,309 | B2 | 7/2010 | Tamaddoni-Jahromi et al. |
| 7,967,570 | B2 | 6/2011 | Shi et al. |
| 8,387,678 | B1 | 3/2013 | Park et al. |
| 2005/0016710 | A1 | 1/2005 | Malterer |
| 2005/0271886 | A1 | 12/2005 | Cetel |
| 2007/0240845 | A1 | 10/2007 | Graham et al. |
| 2008/0237403 | A1 | 10/2008 | Kelly et al. |
| 2009/0165988 | A1 | 7/2009 | Rockstroh et al. |
| 2009/0196760 | A1 | 8/2009 | Harada et al. |
| 2009/0269193 | A1 | 10/2009 | Larose et al. |
| 2010/0254822 | A1 | 10/2010 | Hazel et al. |
| 2010/0297467 | A1 | 11/2010 | Sawtell et al. |
| 2010/0329921 | A1 | 12/2010 | Miller et al. |
| 2011/0123386 | A1 | 5/2011 | Mitchell et al. |
| 2011/0158887 | A1 | 6/2011 | Stoddard et al. |
| 2011/0293431 | A1 | 12/2011 | Harders et al. |
| 2014/0037981 | A1 | 2/2014 | Cui et al. |

FOREIGN PATENT DOCUMENTS

| | | | |
|---|---|---|---|
| JP | 2012532250 | A | 12/2012 |
| WO | 2014093826 | A2 | 6/2014 |
| WO | 2014133635 | A2 | 9/2014 |

OTHER PUBLICATIONS

Singapore Search Report and Written Opinion for Singapore Patent Application No. 11201503276P, dated Mar. 8, 2016.
International Search Report and Written Opinion for PCT/US2013/075017, dated Sep. 24, 2014.
International Search Report and Written Opinion for PCT/US2013/074956, dated Sep. 24, 2014.
Singapore Invitation to Respond to Written Opinion dated Jan. 10, 2017 for Singapore Patent Application No. 11201503276P.
Office action dated Jul. 21, 2017 for U.S. Appl. No. 14/106,007.

* cited by examiner

HYBRID TURBINE BLADE FOR IMPROVED ENGINE PERFORMANCE OR ARCHITECTURE

CROSS-REFERENCE TO RELATED APPLICATION

Benefit is claimed of U.S. patent application Ser. No. 61/737,530, filed Dec. 14, 2012, and entitled "Hybrid Turbine Blade for Improved Engine Performance or Architecture", the disclosure of which is incorporated by reference herein in its entirety as if set forth at length.

BACKGROUND

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor section and the fan section.

In a two-spool engine, the compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device such as an epicyclical gear assembly may be utilized to drive the fan section such that the fan section may rotate at a speed different than the driving turbine section so as to increase the overall propulsive efficiency of the engine. In such engine architectures, a shaft driven by one of the turbine sections provides an input to the epicyclical gear assembly that drives the fan section at a reduced speed such that both the turbine section and the fan section can rotate at closer to optimal speeds.

SUMMARY

One aspect of the disclosure involves a component, a gas turbine engine component, a gas turbine engine or a method related thereto, comprising: a component body including at least a first section of a first material and a second section of a second material that differs from the first material in at least one of composition, microstructure and mechanical properties, the first section and the second section being metallurgically bonded to each other in a boundary zone having a mixture of the first material and the second material.

A further embodiment may additionally and/or alternatively include the component, gas turbine engine component, gas turbine engine or method related thereto, wherein the component body further comprises: a third section of a third material that differs from the first material and the second material, the third section and the second section being metallurgically bonded to each other in a boundary zone having a mixture of the third material and the second material.

A further embodiment may additionally and/or alternatively include the component, gas turbine engine component, gas turbine engine or method related thereto, wherein: the first material is a Group C alloy of Table I or an alloy having a compositional range for a Group C alloy below; the second material is a Group A alloy of Table I or an alloy having a compositional range for a Group A alloy below; and the third material is a Group B alloy of Table I or an alloy having a compositional range for a Group B alloy below.

Another aspect of the disclosure involves a method of casting, comprising: introducing a first molten alloy into a mold; partially solidifying the first molten alloy to form a solidified section, with a remaining molten portion on the solidified section; and introducing a second molten alloy into the mold such that the remaining molten portion and the second molten alloy at least partially mix, the first molten alloy and second molten alloy differing in chemistry.

A further embodiment may additionally and/or alternatively include the introduction of the second molten alloy having a continuous pour of the second molten alloy to both form the mixture and form a further portion after solidifying the mixture.

A further embodiment may additionally and/or alternatively include the introduction of the second molten alloy comprising a first pour of the second molten alloy whereafter the mixture is solidified and a second pour onto the solidified mixture and solidifying to form another solidified section such that the solidified mixture metallurgically bonds the solidified sections together.

Another aspect of the disclosure involves a component, a gas turbine engine component, a gas turbine engine or a method related thereto, comprising any feature described or shown herein, individually or in combination, with any other feature or features described or shown herein.

Another aspect of the disclosure involves a method of casting a blade. The blade has an attachment root and an airfoil. The airfoil has a proximal end and a distal end. The method comprises introducing a molten alloy into a mold and varying a composition of the introduced alloy during the introduction so as to produce a compositional variation.

A further embodiment may additionally and/or alternatively include the compositional variation including variation along the airfoil.

A further embodiment may additionally and/or alternatively include the compositional variation providing an outboard portion of the blade with a lower density than an inboard portion of the blade.

A further embodiment may additionally and/or alternatively include the compositional variation providing an outboard portion of the airfoil with a lower density than an inboard portion of the airfoil.

A further embodiment may additionally and/or alternatively include the compositional variation providing three compositional zones with transitions between adjacent zones.

A further embodiment may additionally and/or alternatively include the three compositional zones comprising a first zone at least partially along the attachment root, a second zone at least partially along the airfoil and a third zone outboard of the second zone.

A further embodiment may additionally and/or alternatively include: the first zone being formed by a Group C alloy of Table I or by an alloy having a compositional range for a Group C alloy below; the second zone being formed by a Group A alloy of Table I or by an alloy having a compositional range for a Group A alloy below; and the third zone being formed by a Group B alloy of Table I or by an alloy having a compositional range for a Group B alloy below.

A further embodiment may additionally and/or alternatively include at least partially during the introduction, cooling the mold so as to solidify the introduced alloy, the varying occurring at least partially during the solidifying.

A further embodiment may additionally and/or alternatively include the blade having a shroud at the airfoil distal end and at least a portion of the shroud having a lower density than at least a portion of the airfoil.

A further embodiment may additionally and/or alternatively include the blade comprising a nickel-base superalloy.

A further embodiment may additionally and/or alternatively include the blade comprising a single crystal or directionally solidified microstructure extending across two zones of different composition and a transition therebetween.

A further embodiment may additionally and/or alternatively include the blade having a density variation of at least 3%.

A further embodiment may additionally and/or alternatively include the blade having a density variation of 6-10%.

A further embodiment may additionally and/or alternatively include the introducing and varying comprising a bottom-feed pour followed by at least one top feed pour.

A further embodiment may additionally and/or alternatively include the introducing and varying comprising a series of top feed pours without any bottom-feed pour.

A further embodiment may additionally and/or alternatively include the introducing and varying comprising introducing a first alloy to a mold cavity via along a first flow path through a first port and introducing a second alloy, differing in composition from the first alloy, to the mold cavity along a second flow path through a second port but not through the first port.

A further embodiment may additionally and/or alternatively include the first flow path and second flow path partially overlapping along a portion of a downsprue.

A further embodiment may additionally and/or alternatively include the first flow path passing through a grain starter and the second flow bypassing the grain starter.

A further embodiment may additionally and/or alternatively include the first alloy having solidified to block the first port by the time the second alloy is introduced.

A further embodiment may additionally and/or alternatively include the introducing and varying further comprising introducing a third alloy, differing in composition from the first alloy and second alloy, to the mold cavity along a third flow path through a third port but not through the first port or second port.

Another aspect of the disclosure involves an alloy comprising, by weight percent: nickel as a largest content; 4.5-8.5 Cr; 0.5-1.5 Mo; 2.5-3.5 W; 1.5-2.5 Ta; 5.5-7.5 Al; 4.5-5.5 Co; 0-4.0 Re; and 0.05-0.20 Hf.

A further embodiment may additionally and/or alternatively include the alloy consisting essentially of said composition.

A further embodiment may additionally and/or alternatively include the alloy further comprising no more than trace amounts of other elements, if any.

A further embodiment may additionally and/or alternatively include the alloy used along an outboard portion of a blade airfoil, with a denser and/or less oxidation resistant alloy along an inboard portion of the airfoil.

A further embodiment may additionally and/or alternatively include the alloy used along an outboard portion of a blade airfoil, with an at least 5% denser alloy along an inboard portion of the airfoil.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
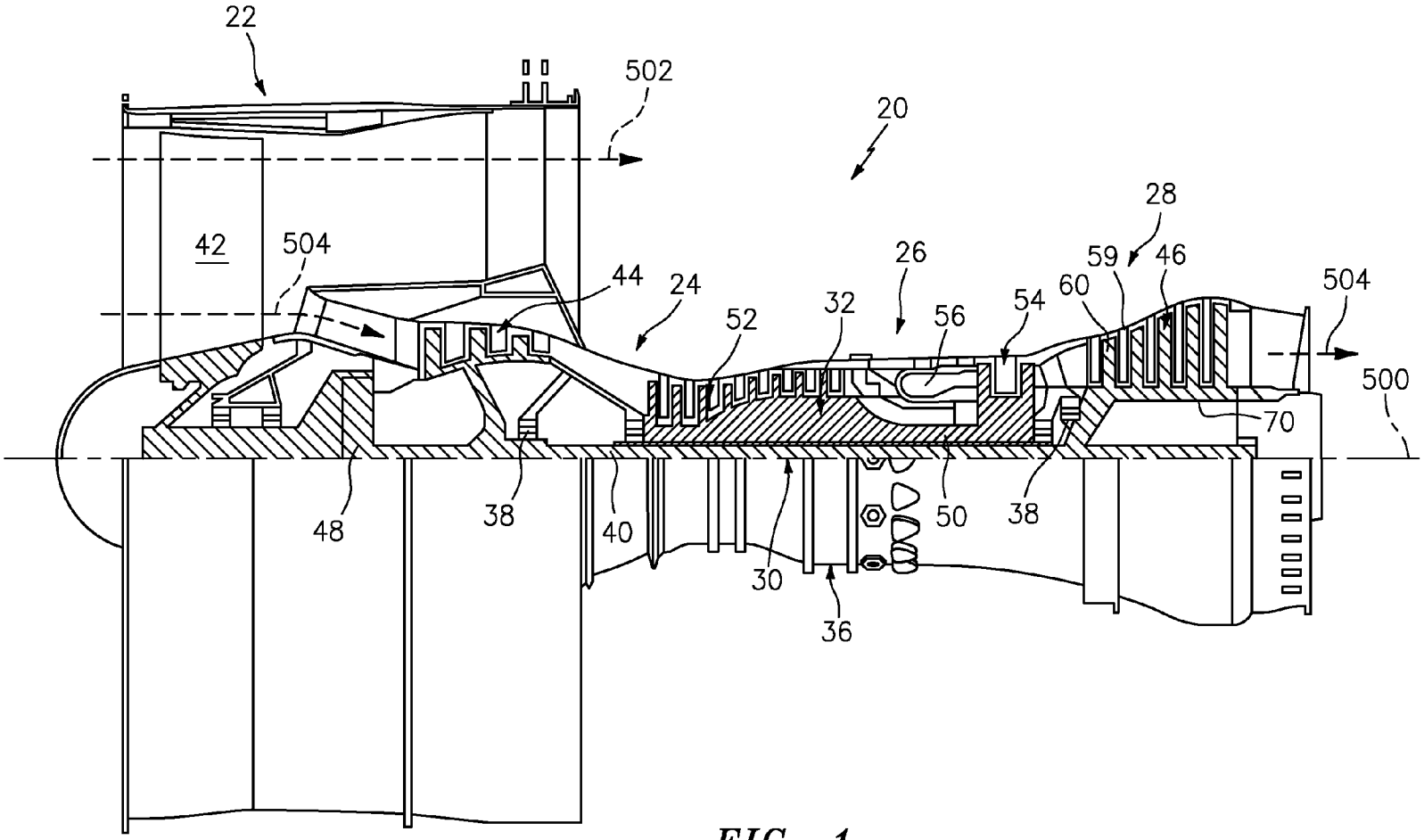
FIG. 1 is a partially schematic half axial sectional view of an exemplary turbofan engine.

FIG. 1 schematically illustrates a gas turbine engine 20. The exemplary gas turbine engine 20 is a two-spool turbofan having a centerline (central longitudinal axis) 500, a fan section 22, a compressor section 24, a combustor section 26 and a turbine section 28. Alternative engines might include an augmentor section (not shown) among other systems or features. The fan section 22 drives air along a bypass flowpath 502 while the compressor section 24 drives air along a core flowpath 504 for compression and communication into the combustor section 26 then expansion through the turbine section 28. Although depicted as a turbofan gas turbine engine in the disclosed non-limiting embodiment, it is to be understood that the concepts described herein are not limited to use with turbofan engines and the teachings can be applied to non-engine components or other types of turbomachines, including three-spool architectures and turbine engines that do not have a fan section.

The engine 20 includes a first spool 30 and a second spool 32 mounted for rotation about the centerline 500 relative to an engine static structure 36 via several bearing systems 38. It should be understood that various bearing systems 38 at various locations may alternatively or additionally be provided.

The first spool 30 includes a first shaft 40 that interconnects a fan 42, a first compressor 44 and a first turbine 46. The first shaft 40 is connected to the fan 42 through a gear assembly of a fan drive gear system (transmission) 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. A combustor 56 (e.g., an annular combustor) is between the second compressor 52 and the second turbine 54 along the core flowpath. The first shaft 40 and the second shaft 50 are concentric and rotate via bearing systems 38 about the centerline 500.

The core airflow is compressed by the first compressor 44 then the second compressor 52, mixed and burned with fuel in the combustor 56, then expanded over the second turbine 54 and first turbine 46. The first turbine 46 and the second turbine 54 rotationally drive, respectively, the first spool 30 and the second spool 32 in response to the expansion.

Figure 2:
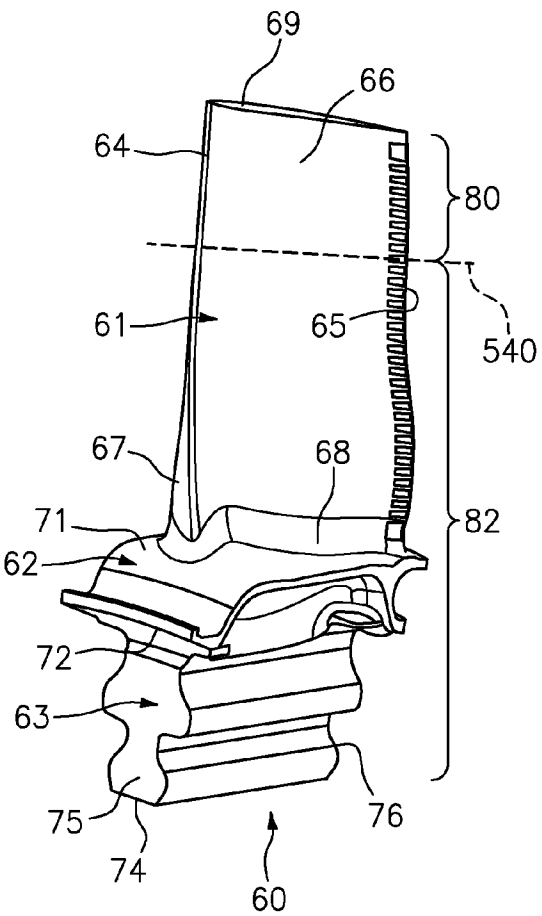
FIG. 2 is a view of a turbine blade such as an engine and having two compositional zones.

The engine 20 includes many components that are or can be fabricated of metallic materials, such as aluminum alloys and superalloys. As an example, the engine 20 includes rotatable blades 60 and static vanes 59 in the turbine section 28. The blades 60 and vanes 59 can be fabricated of superalloy materials, such as cobalt- or nickel-based alloys. The blade 60 (FIG. 2) includes an airfoil 61 that projects outwardly from a platform 62. A root portion 63 (e.g., having a "fir tree" profile) extends inwardly from the platform 62 and serves as an attachment for mounting the blade in a complementary slot on a disk 70 (shown schematically in FIG. 1). The airfoil 61 extends spanwise from a leading edge 64 to a trailing edge 65 and has a pressure side 66 and a suction side 67. The airfoil extends from a proximal/inboard end 68 at the outer diameter (OD) surface 71 of the platform 62 to a distal/outboard end tip 69 (shown as a free tip rather than a shrouded tip (see, FIG. 6 below) in this example).

The root 63 extends from an outboard end at an underside 72 of the platform to an inboard end 74 and has a forward face 75 and an aft face 76 which align with corresponding faces of the disk when installed.

The blade 60 has a body or substrate that has a hybrid composition and microstructure. For example, a "body" is a main or central foundational part, distinct from subordinate features, such as coatings or the like that are supported by the underlying body and depend primarily on the shape of the underlying body for their own shape. As can be appreciated however, although the examples and potential benefits may be described herein with respect to the blades 60, the examples can also be extended to the vanes 59, disk 70, other rotatable metallic components of the engine 20, non-rotatable metallic components of the engine 20, or metallic non-engine components.

The blade 60 has a tipward first section 80 fabricated of a first material and a rootward second section 82 fabricated of a second, different material. A boundary between the sections is shown as 540. For example, the first and second materials differ in at least one of composition, microstructure and mechanical properties. In a further example, the first and second materials differ in at least density. In one example, the first material (near the tip of the blade 60) has a relatively low density and the second material has a relatively higher density. The first and second materials can additionally or alternatively differ in other characteristics, such as corrosion resistance, strength, creep resistance, fatigue resistance, or the like.

In this example, the sections 80/82 each include portions of the airfoil 61. Alternatively, or in addition to the sections 80/82, the blade 60 can have other sections, such as the platform 62 and the root portion 63, which are independently fabricated of third or further materials that differ in at least one of composition, microstructure and mechanical properties from each other and, optionally, also differ from the sections 80/82 in at least one of composition, microstructure, and mechanical properties.

In this example, the airfoil 61 extends over a span from a 0% span at the platform 62 to a 100% span at the tip 69. The section 82 extends from the 0% span to X% span (at boundary 540) and the section 80 extends from the X% span to the 100% span. In one example, the X% span is, or is approximately, 70% such that the section 80 extends from 70% to 100% span. In other examples, the X% can be anywhere from 1%-99%. In a further example, the densities of the first and second materials differ by at least 3%. In a further example, the densities differ by at least 6%, and in one example differ by 6%-10%. As is discussed further below, the X% span location and boundary 540 may represent the center of a short transition region between sections of the two pure first and second materials.

The first and second materials of the respective sections 80/82 can be selected to locally tailor the performance of the blade 60. For example, the first and second materials can be selected according to local conditions and requirements for corrosion resistance, strength, creep resistance, fatigue resistance or the like. Further, various benefits can be achieved by locally tailoring the materials. For instance, depending on a desired purpose or objective, the materials can be tailored to reduce cost, to enhance performance, to reduce weight or a combination thereof In one example, the blade 60, or other hybrid component, is fabricated using a casting process. For example, the casting process can be an investment casting process that is used to cast a single crystal microstructure (with no high angle boundaries), a directional (columnar grain) microstructure, or an equiaxed microstructure. In one example of fabricating the blade 60 by casting, the casting process introduces two, or more, alloys that correspond to the first and second (or more) materials. For example, the alloys are poured into an investment casting mold at different stages in the cooling cycle to form the sections 80/82 of the blade 60. The following example is based on a directionally solidified, single crystal casting technique to fabricate a nickel-based blade, but can also be applied to other casting techniques, other material compositions, and other components.

At least two nickel-based alloys of different composition (and different density upon cooling) are poured into an investment casting mold at different stages of the withdrawal and solidification process of the casting. For instance, in a tip-upward casting example of the blade 60, the alloy corresponding to the second material is poured into the mold to form the root 63, the platform 62 and the airfoil portion of second section 82. As the mold is withdrawn from the heating chamber, the alloy in the root 63 begins to solidify. With further withdrawal, a solidification front moves upwards (in this example) toward the platform 62 and airfoil portion of the second section 82. Prior to complete solidification of the alloy at the top of the second section 82, another alloy corresponding to the first material of the first section 80 is poured into the mold. The additional alloy mixes in a liquid state with the still liquid alloy at the top of the second section 82. As the solidification front continues upwards, the two mixed alloys solidify in a boundary portion (zone) between the sections 80/82. As additional alloy of the first material is poured into the mold, the boundary zone transitions to fully being alloy of the first material as the first section 80 solidifies. Thus, the boundary zone provides a strong metallurgical bond between the two alloys of the sections 80/82 from the mixing of the alloys in the liquid state, and thus does not have some of the drawbacks of solid-state bonds (e.g., solid state bonds providing locations for crack initiation).

In single crystal investment castings, a seed of one alloy can be used to preferentially orient a compositionally different casting alloy. Furthermore, nickel-based alloy coatings strongly bond to nickel-based alloy substrates of different composition. The seeding and bonding suggests that the approach of multi-material casting with the metallurgical bond of the boundary zone is feasible to produce a strong bond.

Additionally, lattice parameters and thermal expansion mismatches between different composition nickel-based alloys are relatively insignificant, which suggests that the boundary between the sections 80/82 is unlikely to be a detrimental structural anomaly. Also, for nickel-based alloys, unless such boundary zones are subjected to temperatures in excess of 2000° F. (1093° C.) for substantial periods of time, it is unlikely that the compositions and microstructural stability in the boundary zone will be significantly compromised. Alternatively, the alloys can be selected to reduce or mitigate any such effects to meet engineering requirements. As can be further appreciated, the same approach can be applied to conventionally cast components with equiaxed grain structure, as well directionally solidified castings with columnar grain structure.

For a rotatable component, such as the blade 60 or disk 70, the centrifugal pull at any location is proportional to the product of mass, radial distance from the center and square of the angular velocity (proportional to revolutions per minute). Thus, the mass at the tip has a greater pull than the mass near the attachment location. By the same token, the strength requirement near to the rotational axis is much higher than the strength requirement near the tip. Therefore, the blade 60 having the first section 80 fabricated of a relatively low density material (near the tip) can be beneficial, even if the selected material of the first section 80 does not have the same strength capability as the material selected for the second section 82.

Also, the radial pull is significantly higher than the pressure load experienced by the blade 60 along the engine central axis 500. This suggests that the blade 60, with a low-density/low strength alloy at the tip, would be greatly beneficial to the engine 20 by either improving engine efficiency or by modifying blade geometry for a longer or broader blade or by reducing the pull on the disk 70 and reducing the engine weight, as well as shrinking the bore of the disk 70 axially, thereby improving the engine architecture.

Similarly, in some embodiments, it can be beneficial to fabricate the root 63 of the blade 60 with a more corrosion resistant and stress corrosion resistant (SCC) alloy and to fabricate the airfoil 61 (or portions thereof) with a more creep resistant alloy. Given that not all engineering properties are required to the same extent at different locations in a component, the weight, cost, and performance of a component, such as the blade 60, can be locally tailored to thereby improve the performance of the engine 20.

The examples herein may be used to achieve various purposes, such as but not limited to, (1) light weight components such as blades, vanes, seals etc., (2) blades with light weight tip and/or shroud, thereby reducing the pull on the blade root attachment and rotating disk, (3) longer or wider blades improving engine efficiency, rather than reducing the weight, (4) corrosion and SCC-resistant roots with creep-resistant airfoils, (5) root attachments with high tensile and low cycle fatigue strength and airfoils with high creep resistance, (6) reduced use of high cost elements such as Re in the root portion 63 or other locations, and (7) reduction in investment core and shell reactions with active elements in in one or more of the zones. An example of the last purpose involves a situation where more of a particular element is desired in one zone than in another zone. For example in a blade it may be desired to have more of certain reactive elements (e.g., that contribute to oxidation resistance) in the airfoil (or other tipward zone) than in the root (or other rootward zone). In a single-pour tip-downward casting, the alloy will have a greater time in the molten state as one progresses from tip to root. There will be more time for the reactive elements to react with core and shell near the root. Although this can yield acceptable amounts of those reactive elements in the blade, the reaction can degrade the interface between casting and core/shell. The reactions may alter local core/shell compositions so as to make it difficult to leach the core. Thus, the later pour (forming the root in this example) may be of an alloy having relatively low (or none) concentrations of the reactive elements.

Additionally, in some embodiments, the examples herein provide the ability to enhance performance without using costly ceramic matrix composite materials. The examples herein can also be used to change or expand the blade geometry, which is otherwise limited by the blade pull, disk strength and space availability. Furthermore, the examples expand the operating envelope of the geared architecture of the engine 20, where higher rotational speeds of the hot, turbine section 20 are feasible since the rotational speed of the turbine section 28 is not necessarily constrained by the rotational speed of the fan 42 because the fan speed can be adjusted through the gear ratio of the gear assembly 48.

Typically a single crystal nickel-base superalloy component, such as a turbine blade may be cast as follows. A ceramic and/or a refractory metal core or assembly is made, which will ultimately define the internal hollow passages in the turbine blade. Using a die, wax is injected around the core to form a pattern which will eventually define the external shape of the blade. The solid wax with embedded core assembly (and optionally with other wax gating components or additional patterns attached) is then dipped in ceramic slurry to form the outer shell mold. Once the shell is dried, the wax is melted and drained out leaving behind a hollow cavity between the outer shell and the inner core. The assembly is then fired to harden the shell (mold).

Such a mold assembly (typically with a feed tube (e.g. a downsprue for bottom fill shells) and a pour cup) is then placed on a water-cooled chill plate inside an induction heated furnace, enclosed in a vacuum chamber. These features (tube, downsprue, pour cup) may be formed by shelling wax pattern elements either with or separately from the shelling of the blade patterns.

If the alloy is to be cast with the naturally favored <100> orientation along the long axis of the blade (the spanwise direction) the shell may include means such as a hollow helical passage joined to a hollow cavity at the bottom, to form a starter block (grain starter). Wax forming the helix and block may be molded as part of the pattern or secured thereto prior to shelling.

If it is desired to cast the alloy with controlled crystal orientation, then the hollow cavity below the helical passage may be filled with a block of solid single crystal of the desired orientation. This solid block is referred to as a seed. This seed need not be parallel to the axis of the blade. It may be tilted at a desired angle. That provides flexibility in selecting the starting seed and the desired orientation of the casting.

If the mold assembly were to be grown naturally with no seed, then a molten metal charge is melted in the melt cup and poured through the pour cup to fill the mold. The mold can be top fed or bottom fed. A filter may be used in the feed tube to capture any ceramic or solid inclusion in the liquid metal as shown. Once the mold is filled, the radiation from the susceptors heated by the induction coils keep the metal molten. Subsequently the mold is withdrawn from the furnace past/through the baffle which isolates the hot zone of the furnace from the cold zone below. Typically the withdrawal rate is 1-10 inches/hour (2.5 mm/hour-0.25 m/hour), depending on the complexity and size of the part. The part of the mold that gets withdrawn below the baffle starts solidifying due to the rapid cooling from the chill plate. Because that solidification is largely due to heat transfer through the chill plate it is highly biased in the direction of withdrawal. That is why the process is called directional solidification. Due to directional solidification, the starter block forms columns of grain of crystal of which the helical passage allows only one to survive. This results in a single crystal casting with <100> crystallographic or cube direction parallel to the blade axis.

If the mold is designed to be started with a seed, then it may be positioned in such a way that half of the seed is below the baffle. Now when the molten metal is poured, the half of the seed above the baffle melts and mixes with the new metal. Soon after this occurs, the mold is withdrawn as described above. In this case however, the metal cast in the mold becomes single crystal with the orientation defined by the seed.

According to the present disclosure, a compositional variation may be imposed along the blade. This may entail two or more zones with transitions in between.

An exemplary two-zone blade involves a transition at a location along the airfoil.

For example, an inboard region of the airfoil is under centrifugal load from the portion outboard thereof (e.g., including any shroud). Reducing density of the outboard portion reduces this loading and is possible because the outboard portion may be subject to lower loading (thus allowing the outboard portion to be made of an alloy weaker in creep). An exemplary transition location may be between 30 and 80% span, more particularly 50-75% or 60-75% or an exemplary 70%.

To create such compositional zones, the mold cavity may be filled with a given alloy to a desired intermediate height determined by the design requirement.

In a tip-downward casting, a low density first alloy will be poured just sufficient to fill the outboard portion, and withdrawal process begins. As the transition location in the cavity approaches the baffle, a second alloy with higher creep strength is poured to fill the rest of the mold. This may be achieved by adding ingot(s) of the second alloy in the melt crucible and pouring the molten second alloy into the pour cup.

Figure 4:
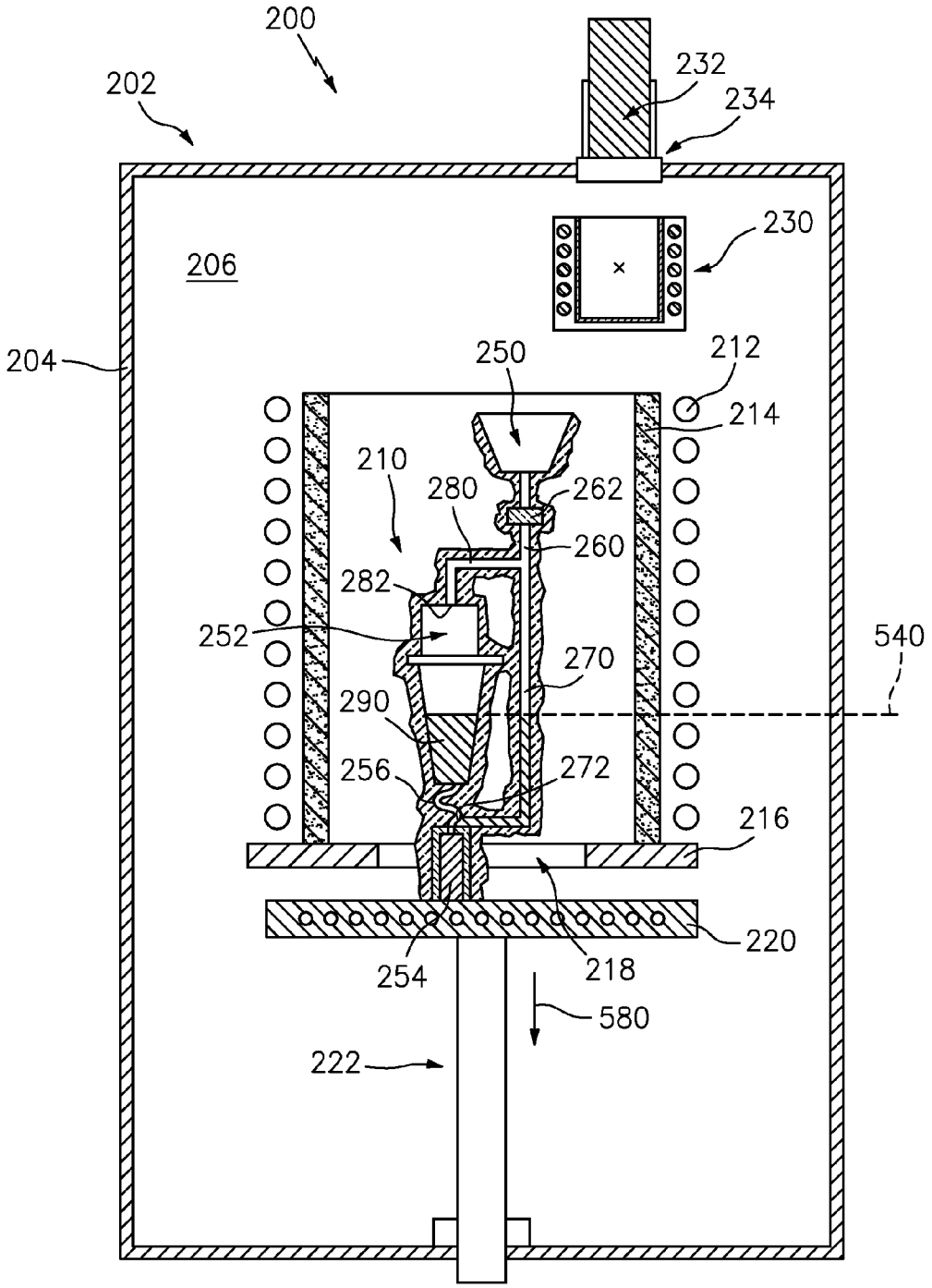
FIG. 4 is a schematic sectional view of a first casting apparatus.

FIG. 4 shows a baseline casting system 200 modified for such purpose. The system 200 comprises a furnace 202 which includes a vacuum chamber 204 having an interior 206. For heating a mold or shell 210, the furnace includes an induction coil 212 surrounding a susceptor 214.

A baffle 216 is positioned at the bottom of the susceptor and has a central opening or aperture 218 for downwardly passing the shell 210 as it is withdrawn from a heating zone defined by the coil and susceptor and allowed to cool as it passes below the baffle. The shell is supported atop a chill plate 220 (e.g., water cooled) which is held by an elevator or actuator 222 to vertically move the chill plate (e.g., descend in a downward direction 580).

FIG. 4 further shows a melt crucible 230 for receiving and melting metallic ingots 232. The ingots may be introduced through an air lock 234 and deposited into the crucible for melting. The crucible may have an actuator (not shown) for pouring the alloy into a pour cup 250 of the shell.

The exemplary shell is for casting a blade in a tip-downward condition and has an internal cavity 252 generally corresponding to features of such blade. At a lower end of the shell, the shell includes a starter seed 254. A spiral starter passageway (helical grain starter) 256 extends upward to the cavity.

For introducing alloy to the cavity 252, a downsprue or feeder 260 extends downwardly from a base of the cup. The exemplary downsprue contains an inline filter 262. As so far described, the system may be representative of any of numerous prior art systems and yet other prior art systems may be used. An exemplary modification, however, involves splitting the downsprue or feeder into two branches for respectively introducing two pours of two different alloys. The downsprue includes a first branch which may provide a bottom fill and may comprise a conduit 270 having an outlet port 272 relatively low on the shell. The exemplary port 272 is below the desired transition 540 and, more particularly, below the lowest end of the part to be cast. The exemplary outlet may be positioned to direct flow to the seed (if any) 254 and helical grain starter 256 so that the flowpath passes downward through this branch and upward through the grain starter to a port at the mold cavity where the blade is molded (e.g., at the tip). In this embodiment, however, a second branch 280 branches off the downsprue downstream of the filter. The second branch provides a top-fill flowpath to a port 282 relatively high on the shell. The exemplary port 282 is at a top of the mold cavity (e.g., at the inner diameter (ID) end of the root). As is discussed further below, withdrawal may be synchronized so that a first pour of one alloy may pass through the first branch (and optionally or preferably not the second branch) to provide a desired amount of a first alloy in a tip-inward region. Thereafter, a second pour of a second alloy may be applied to the same pour cup. However, the second pour will find the first branch blocked because, along at least a portion of the first flowpath, the metal 290 of the first pour will have solidified to block further communication. Accordingly, the second pour or shot will pass as a top fill through the second port. This top-fill does not block further pours until the cavity is full. Accordingly, the second pour may terminate before the cavity is filled and a third pour (through the second port) may similarly fill a remainder of the cavity to create three zones of differing composition. Clearly, this process might be extended to allow additional pours.

In yet further embodiments, the second pour or one or more later pours may effectively be bottom-fill by locating a gate/port between the downsprue and the cavity at an intermediate height. For example, in the FIG. 4 embodiment, an additional gate/port just above the fill line of the first pour would allow the second pour to fill its associated region of the cavity by basically a bottom fill process. Thereafter, the third pour could be a top fill or there could be yet additional intermediate ports so that one or more additional pours are at least locally bottom fill.

Both the withdrawal process and the second pouring may be coordinated in such a way that minimal mixing of the alloys occurs so that large composition gradients between essentially pure bodies of the two alloys are brief (e.g., less than 10% span or less than 5% span).

It is possible the first alloy may be completely solidified before adding the second alloy, but mixing may occur with just sufficient remaining initial alloy in the liquid state to provide a robust transition to the second alloy. Similarly, multiple pours of a given alloy are possible (e.g., splitting the pouring of the second alloy into two pours after the pour of the first alloy such that a first pour of the second alloy forms a transition region with remaining molten first alloy is allowed to partially or fully solidify before a second pour of the second alloy is made).

Various modifications and optimizations may be made. If needed such a process may also benefit with the addition of deoxidizing elements like Ca, Mg, and similar active elements. However, an exemplary approach is to avoid that to provide clean practice and process control.

The procedure described above can be practiced with multiple alloys and any section of the casting desired. It is understood that where one wants the transition between two or more alloys to take place depends on the optimized design and desired performance of the particular components. This is controlled by yield strength, fatigue strength, creep strength, as well as desired oxidation resistance and corrosion resistance of the alloy candidate(s) chosen. The key physical basis to be recognized is that the epitaxial crystallographic relationship is maintained when casting alloys within the class of FCC solid solution hardened and precipitation hardened nickel base alloys used for blades and other gas turbine engine and industrial engine components.

It is understood that a lack of epitaxial relationship leading to formation of a grain boundary may be tolerable if such structurally weak interfaces are sufficiently strengthened by alloying additions and/or are acceptable for the specific structural design such as a long blade with less pull at the location.

If the second nickel base alloy is a typical coating-type composition with high concentration of aluminum, having a mix of face centered cubic, and body centered cubic or simple cubic or B2 structure, this approach will also work. Such a combination may be desirable in case one wants the latter alloy to be oxidation resistant or have a higher thermal conductivity. In such a situation, epitaxial relationship is not expected but interfacial bond may be acceptable as formed in liquid state or by inter-diffusion.

The foregoing discusses a method for making multi-alloy single-crystal castings. However, a similar method may provide a low cost columnar grain structure. In such case the casting may still be carried out by directional solidification but no helical passage is used to filter out only one grain. Instead, multiple columnar grains are allowed to run through the casting.

Figure 5:
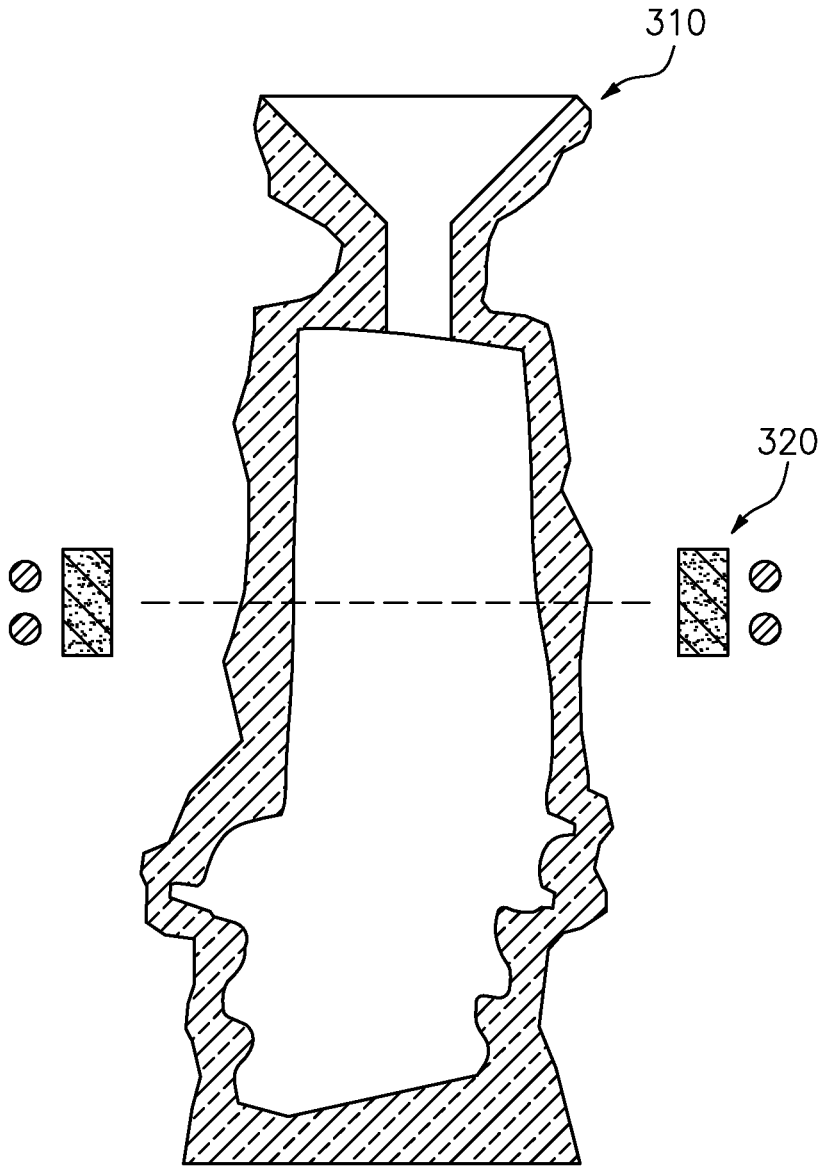
FIG. 5 is a schematic sectional view of a second casting apparatus.

Similarly the process can also be practiced for the lowest cost conventionally cast material with minor modification. As shown in FIG. 5, typically in a conventionally cast material the mold 310 is prepared the same way without the bottom helical passage or a starter block, and liquid metal is simply poured and allowed to solidify. The uncontrolled solidification leads to random formation of many crystals called grains and one ends up with a casting made up of randomly oriented grains. Since the process does not involve any directional solidification, it is fast and require less equipment. If it were desired to make such a casting with two or more alloys, then it is clear that one needs to go through the same procedure of partially filling the mold with the first alloy and then pouring the second alloy. However, again if it is desired that the bonding between the two alloys take place in the liquid state then one may add a local source 320 of heating the transition zone. This source may take the form of an induction heater, resistance tape, or a radiation source.

Or alternatively, the entire process can be carried out in the directionally solidified equipment typically used for single crystal casting, without the chill plate, and with a very rapid withdrawal. For example one can pour the first alloy and withdraw rapidly and hold. Pour the second alloy and withdraw rapidly again to facilitate random cooling.

Figure 3:
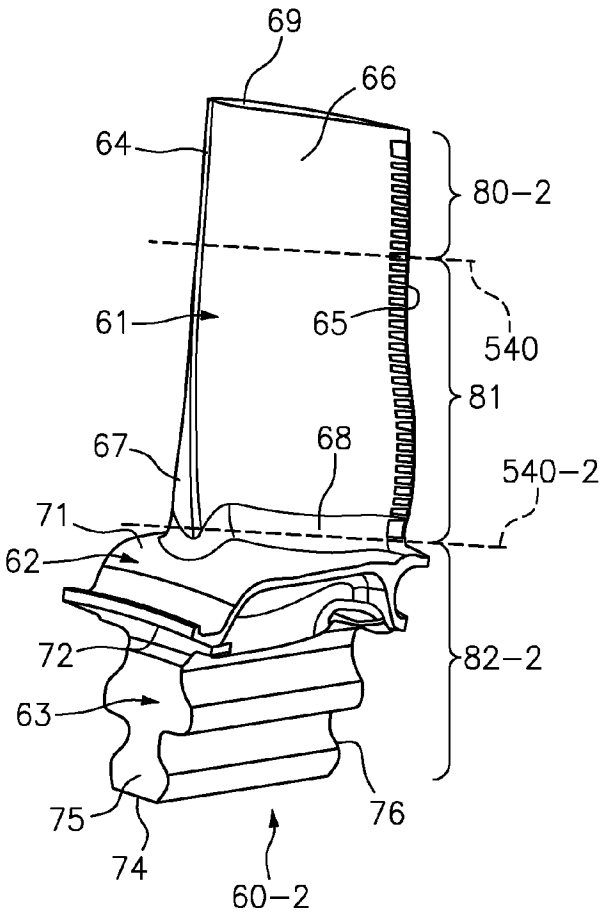
FIG. 3 is a view of such a turbine blade having three compositional zones.

FIG. 3 divides the blade 60-2 into three zones (a tipward Zone 1 numbered 80-2; a rootward Zone 2 numbered 82-2; and an intermediate Zone 3 numbered 81) which may be of two or three different alloys (plus transitions). Desired relative alloy properties for each zone are:

- Zone 1 Airfoil Tip: low density (desirable because this zone imposes centrifugal loads on the other zones) and high oxidation resistance. This may also include a tip shroud (not shown);
- Zone 2 Root & Fir Tree: high notched LCF strength, high stress corrosion cracking (SCC) resistance, low density (low density being desirable because these areas provide a large fraction of total mass);
- Zone 3 Lower Airfoil: high creep strength (due to supporting centrifugal loads with a small cross-section), high oxidation resistance (due to gaspath exposure and heating), higher thermal-mechanical fatigue (TMF) capability/life.

Exemplary Zone 1/3 transition 540 is at 50-80% airfoil span, more particularly 55-75% or 60-70% (e.g., measured at the center of the airfoil section or at half chord). Exemplary Zone 2/3 transition 540-2 is at about 0% span (e.g., −5% to 5%).

Table I (split into Tables I A and I B) shows compositions of three groups of alloys which may be used in various combinations of a two-zone or three-zone blade. Relative to the other groups, general relative properties are:

- Group A: high creep strength & oxidation resistance;
- Group B: low density and good oxidation resistance; and
- Group C: high attachment LCF strength and stress corrosion cracking (SCC) resistance.

TABLE I A

| | | Composition, Weight % | | | | | | | | | | | | |
|---|---|---|---|---|---|---|---|---|---|---|---|---|---|---|
| Alloy | Alloy Group | Cr | Ti | Mo | W | Ta | Other | Al | Co | Re | Ru | Hf | C | Y |
| PWA 1484 | A | 5 | | 1.9 | 5.9 | 8.7 | | 5.65 | 10 | 3 | | 0.1 | | |
| PWA 1487 | | 5 | | 1.9 | 5.9 | 8.7 | | 5.65 | 10 | 3 | | 0.35 | | 0.01 |
| PWA 1497 | | 2 | | 1.8 | 6 | 8.25 | | 5.65 | 16.5 | 6 | 3 | 0.15 | 0.05 | |
| Rene N5 | | 7 | | 1.5 | 5 | 6.5 | | 6.2 | 7.5 | 3 | | 0.15 | | 0.01 |
| Rene N6 | | 4 | | 1 | 6 | 7 | | 5.8 | 12 | 5 | | 0.2 | | |
| CMSX-4 | | 6.5 | 1 | 0.6 | 6 | 6.5 | | 5.6 | 9 | 3 | | 0.1 | | |
| PWA 1430 | | 3.75 | | 1.9 | 8.9 | 8.7 | | 5.85 | 12.5 | 0 | | 0.3 | | |
| Rene N500 | | 6 | | 2 | 6 | 6.5 | | 6.2 | 7.5 | 0 | | 0.6 | | |
| Rene N515 | | 6 | | 2 | 6 | 6.5 | | 6.2 | 7.5 | 1.5 | | 0.38 | | |
| TMS-138A | | 3.2 | | 2.8 | 5.6 | 5.6 | | 5.7 | 5.8 | 5.8 | 3.6 | 0.1 | | |
| TMS-196 | | 4.6 | | 2.4 | 5 | 5.6 | | 5.6 | 5.6 | 6.4 | 5 | 0.1 | | |
| TMS-238 | | 4.6 | | 1.1 | 4 | 7.6 | | 5.9 | 6.5 | 6.4 | 5 | 0.1 | | |
| CMSX-10 | | 2 | 0.2 | 0.4 | 5 | 8 | 0.05Nb | 5.7 | 3 | 6 | | 0.1 | | |
| CM 186LC | | 6 | 0.7 | 0.5 | 8 | 3 | | 5.7 | 9 | 3 | | 1.4 | 0.07 | |
| CMSX-486 | | 5 | 0.7 | 0.7 | 9 | 4.5 | | 5.7 | 9 | 3 | | 1 | 0.07 | |

TABLE I A-continued

| Alloy | Alloy Group | Cr | Ti | Mo | W | Ta | Other | Al | Co | Re | Ru | Hf | C | Y |
|---|---|---|---|---|---|---|---|---|---|---|---|---|---|---|
| | | Composition, Weight % | | | | | | | | | | | | |
| CMSX-7 | | 6 | 0.8 | 0.6 | 9 | 9 | | 5.7 | 10 | 0 | | 0.3 | | |
| CMSX-8 | | 5.4 | 0.7 | 0.6 | 8 | 8 | | 5.7 | 10 | 1.5 | | 0.3 | | |
| LDSX-B | | 8 | | 1.1 | 2 | 4 | | 6.2 | 12.5 | 5 | 2 | 0.1 | | |

TABLE I B

| Alloy | Alloy Group | Cr | Ti | Mo | W | Ta | Other | Al | Co | Re | Ru | Hf | C | Y |
|---|---|---|---|---|---|---|---|---|---|---|---|---|---|---|
| | | Composition, Weight % | | | | | | | | | | | | |
| CMSX-6 | B | 10 | 4.7 | 3 | | 2 | | 4.8 | 5 | | | 0.1 | | |
| Y-1715 GE | | 13 | | | 3.8 | 4.9 | | 6.6 | 7.5 | 1.6 | | 0.14 | 0.04 | |
| LEK-94 | | 6.1 | 1 | 2 | 3.4 | 2.3 | | 6.6 | 7.5 | 2.5 | | 0.1 | | |
| RR-2000 | | 10 | 4 | 3 | | | 1.0V | 5.5 | 15 | | | | | |
| AM 3 | | 8 | 2 | 2 | 5 | 4 | | 6 | 6 | | | | | |
| LDSX-B | | 8 | | 1.1 | 2 | 4 | | 6.2 | 12.5 | 5 | 2 | 0.1 | | |
| LDSX-D | | 6 | | 2 | 4 | 4 | | 6.2 | 12.5 | 5 | 2 | 0.1 | | |
| New 1 | | 5 | | 1 | 3 | 2 | | 6 | 5 | | | 0.1 | | |
| New 2 | | 5 | | 1 | 3 | 2 | | 6.5 | 5 | 3 | | 0.1 | | |
| New 3 | | 8 | | 1 | 3 | 2 | | 6.5 | 5 | | | 0.1 | | |
| New 4 | | 8 | | 1 | 3 | 2 | | 6.5 | 5 | 3 | | 0.1 | | |
| PWA 1480 | C | 10 | 1.5 | | 4 | 12 | | 5 | 5 | | | | | |
| PWA 1440 | | 10 | 1.5 | | 4 | 12 | | 5 | 5 | | | 0.35 | | |
| PWA 1483 | | 12.2 | 4.1 | 1.9 | 3.8 | 5 | | 3.6 | 9 | | | | 0.07 | |
| CMSX-2 | | 8 | 1 | 0.6 | 8 | 6 | | 5.6 | 5 | | | | | |

An exemplary two-zone blade involves a Group A alloy inboard (e.g. along at least part and more particularly all of the root, e.g., in zones 81 and 82-2 or zone 82) and a Group B alloy along at least part of the airfoil (e.g., a portion extending inward from the tip such as zone 80-2 or zone 80). The use of the letters A, B, and C, in this three group example, does not require that A and B be the same as the alloys A and B used in the two group example previously. However, suitable two-shot examples selected from these three groups are given immediately below followed by a three-shot example.

Another exemplary two-zone blade involves a Group A along all or most of the airfoil (e.g., tip inward such as zones 80-2 and 81 or zone 80) and a Group C alloy along at least part of the root (e.g., a root majority or zone 82-2 or zone 82).

An exemplary three-zone blade involves a Group C alloy inboard (e.g., zone 82-2), a Group B alloy outboard (e.g., zone 80-2), and a Group A alloy in between (e.g., zone 81).

For each of the compositions there may be trace or residual impurity levels of unlisted components or components for which no value is given. For each of the groups, a range may comprise the max and min values of each element across the group with a manufacturing tolerance such as 0.1 wt % or 0.2 wt % at each end. Narrower ranges may be similarly defined to remove any number of outlier compositions from either extreme.

In some further embodiments of Group A, exemplary total Mo+W+Ta+Re+Ru>16 wt %, more particularly >19 wt %. Exemplary Al>5.5 wt %, more particularly 5.6-6.4 wt % or 5.7-6.2%. Exemplary Cr>/=4 wt %, more particularly, >/=5 wt % or 4-7 wt % or 5-7 wt % or 5.0-6.5 wt %.

In some further embodiments of Group B, exemplary total Mo+W+Ta+Re+Ru<10 wt %, more particularly <7 wt % or <5 wt %. Exemplary Cr>/=5 wt %, more particularly, >/=6 wt % or 5-10 wt % or 6-9 wt %. Exemplary Al>/=5 wt % more particularly, >/=6 wt % or 6-8 wt % or 6.0-7.0 wt %.

In some further embodiments of Group C, exemplary Cr>/=8 wt %, more particularly >/=10 wt % or 8-13 wt % or 10-13 wt %. Exemplary Ta>/=5 wt %, more particularly 5-13 wt % or 6-12 wt %.

Specific alloys may be chosen to best match characteristics such as common <100> primary orientation, modulus (e.g., within 2%, more broadly 6% or 12%), thermal conductivity (e.g., within 2%, more broadly 3% or 5%, however, a much larger difference (e.g., ~5×) would occur if a nickel aluminide were used as just one of the alloys), and/or thermal expansion (e.g., within 2%, more broadly 6% or 12%).

Four alloys believed novel are included in the table as New1-New4. One characterizations of these new alloys is comprising, by weight percent: nickel as a largest content; 4.5-8.5 Cr; 0.5-1.5 Mo; 2.5-3.5 W; 1.5-2.5 Ta; 5.5-7.5 Al; 4.5-5.5 Co; 0.0-4.0 Re; and 0.05-0.20 Hf.

Another characterization is an alloy comprising, by weight percent: nickel as a largest content; 5-8 Cr; 0.5-1.0 Mo; 2.5-3.5 W; 1.5-2.5 Ta; 5.5-7.5 Al; 4.5-5.5 Co; 0-4 Re; and 0.05-0.20 Hf.

Another characterization is an alloy comprising, by weight percent: nickel as a largest content; 5-8 Cr; 0.5-1.5 Mo; 2.5-3.5 W; 1.5-2.5 Ta; 5.5-7.5 Al; 4.5-5.5 Co; 0-4 Re; and 0.05-0.20 Hf.

Another characterization is an alloy comprising, by weight percent: nickel as a largest content; 4.7-8.3 Cr; 0.7-1.3 Mo; 2.7-3.3 W; 1.7-2.3 Ta; 5.7-7.0 Al; 4.7-5.3 Co; 0-3.5 Re; and 0.05-0.20 Hf.

Another characterization is an alloy comprising, by weight percent: nickel as a largest content; 4.5-8.5 Cr; 0.5-1.5 Mo; 2.5-3.5 W; 1.5-2.5 Ta; 5.5-7.0 Al; 4.5-5.5 Co; 0-4.0 Re; and 0.05-0.20 Hf.

Another characterization is an alloy comprising, by weight percent: nickel as a largest content; 4.5-8.5 Cr; 0.5-1.5 Mo; 2.5-3.5 W; 1.5-2.5 Ta; 5.7-6.75 Al; 4.5-5.5 Co; 0-4.0 Re; and 0.05-0.20 Hf.

Another characterization is an alloy comprising, by weight percent: nickel as a largest content; 7.5-8.5 Cr; 0.5-1.5 Mo; 2.5-3.5 W; 1.5-2.5 Ta; 6.0-7.0 Al; 4.5-5.5 Co; 0-4.0 Re; and 0.05-0.20 Hf.

The different ranges of each of these components in one or more of the characterizations may be substituted into another of the characterizations to create further characterizations. Exemplary density is ≤8.58 g/cm$^3$, more particularly ≤8.50 g/cm$^3$ or 8.05-8.40 g/cm$^3$.

Figure 6:
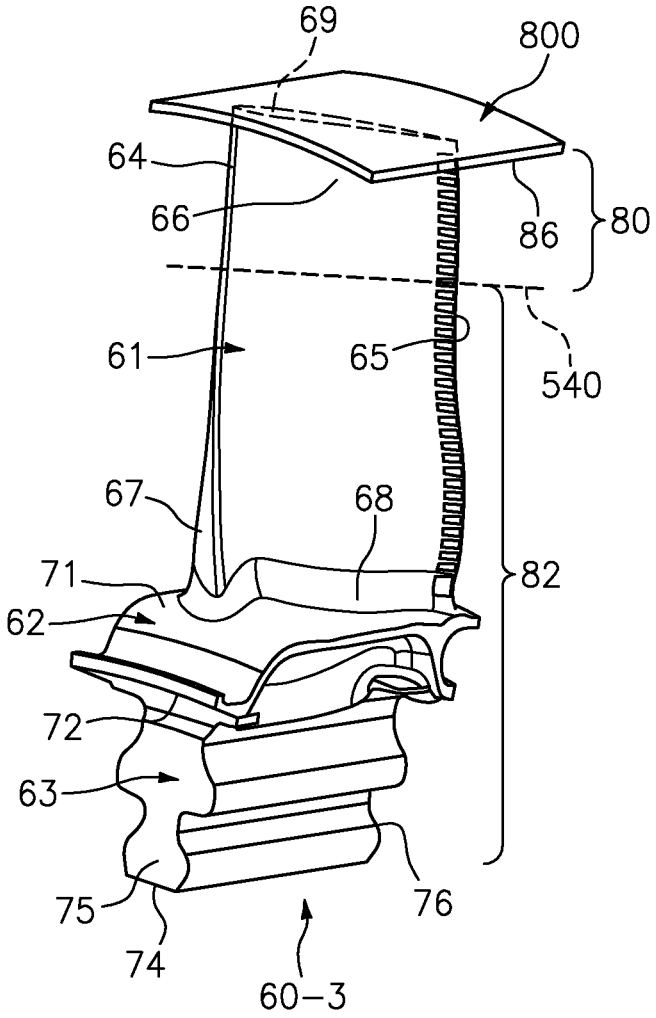
FIG. 6 is a simplified view of a shrouded blade.

FIG. 6 shows a blade 60-3 otherwise similar to 60 (or 60-2) but wherein the airfoil distal end 69 is not a free tip but is along the underside 86 of a tip shroud 88.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic blade or other part configuration, details of such configuration or its associated engine may influence details of particular implementations. Accordingly, other embodiments are within the scope of the following claims.

What is claimed is:

1. An alloy comprising, by weight percent:
nickel as a largest content;
4.5-8.5 Cr;
0.5-1.5 Mo;
2.5-3.5 W;
1.5-2.5 Ta;
5.5-7.5 Al;
4.5-5.5 Co;
0-4 Re; and
0.05-0.20 Hf.

2. The alloy of claim 1 comprising, by weight percent:
5-8 said Cr; and
0.5-1.0 said Mo.

3. The alloy of claim 1 consisting essentially of by weight percent:
nickel as a largest content;
4.5-8.5 Cr;
0.5-1.5 Mo;
2.5-3.5 W;
1.5-2.5 Ta;
5.5-7.5 Al;
4.5-5.5 Co;
0-4 Re; and
0.05-0.20 Hf.

4. The alloy of claim 1 further comprising no more than trace amounts of other elements, if any.

5. The alloy of claim 1 forming a first portion of a blade airfoil, with a denser and less oxidation resistant alloy along a second portion of the airfoil inboard of the first portion.

6. The alloy of claim 1 forming a first portion of a blade airfoil, with an at least 5% denser alloy along a second portion of the airfoil inboard of the first portion.

7. The alloy of claim 5 wherein:
the blade has a shroud at a distal end of the airfoil; and
the shroud is along the first portion.

8. The alloy of claim 5 wherein:
the blade has a density variation of 6-10%.

9. The alloy of claim 1 comprising, by weight percent:
said nickel as a largest content; 7.5-8.5 Cr; 0.5-1.5 Mo; 2.5-3.5 W; 1.5-2.5 Ta; 6.0-7.0 Al; 4.5-5.5 Co; 0-4.0 Re; and 0.05-0.20 Hf.

10. The alloy of claim 1 comprising, by weight percent:
said nickel as a largest content; 4.7-8.3 Cr; 0.7-1.3 Mo; 2.7-3.3 W; 1.7-2.3 Ta; 5.7-7.0 Al; 4.7-5.3 Co; 0-3.5 Re; and 0.05-0.20 Hf.

11. The alloy of claim 1 comprising, by weight percent:
said nickel as a largest content; 4.5-8.5 Cr; 0.5-1.5 Mo; 2.5-3.5 W; 1.5-2.5 Ta; 5.5-7.0 Al; 4.5-5.5 Co; 0-4.0 Re; and 0.05-0.20 Hf.

12. An alloy comprising, by weight percent:
nickel as a largest content;
5-8 Cr
0.5-1.0 Mo;
2.5-3.5 W
1.5-2.5 Ta;
5.5-7.5 Al;
4.5-5.5 Co;
0-4 Re; and
0.05-0.20 Hf.

13. A method of casting a blade, the blade having an attachment root and an airfoil, the airfoil having a proximal end and a distal end, the method comprising:
introducing a molten alloy into a mold; and
varying a composition of the introduced alloy during the introduction so as to produce a compositional variation, the compositional variation providing the alloy of claim 1 along a portion of the blade.

14. The method of claim 13 wherein:
the compositional variation includes variation along the airfoil.

15. The method of claim 13 wherein:
the compositional variation provides said portion as an outboard portion of the blade with a lower density than an inboard portion of the blade.

16. The method of claim 13 wherein:
the compositional variation provides said portion as an outboard portion of the airfoil with a lower density than an inboard portion of the airfoil.

17. The method of claim 13 wherein:
the compositional variation provides three compositional zones with transitions between adjacent zones.

18. The method of claim 17 wherein:
the three compositional zones comprise a first zone at least partially along the attachment root, a second zone at least partially along the airfoil and a third zone outboard of the second zone, the portion being along the third zone.

19. The method of claim 18 wherein:

the first zone is formed by an alloy having in weight percent 10-13 Cr and 6-12 Ta; and the second zone is formed by an alloy having in weight percent 5-7 Cr, 5.6-6.4 Al, and at least 16 combined Mo+W+Ta+Re+Ru.

20. The method of claim 13 further comprising:

at least partially during the introduction, cooling the mold so as to solidify the introduced alloy, the varying occurring at least partially during the solidifying.

21. The method of claim 13 wherein:

the blade comprises a nickel-base superalloy.

22. The method of claim 13 wherein:

the blade comprises a single crystal or directionally solidified columnar grain microstructure extending across two zones of different composition and a transition therebetween.

23. The method of claim 13 wherein:

the blade has a density variation of at least 3%.

24. The method of claim 13 wherein:

the introducing and varying comprise:

a bottom-feed pour followed by at least one top feed pour.

25. The method of claim 13 wherein:

the introducing and varying comprise:

a series of top feed pours without any bottom-feed pour.

26. The method of claim 13 wherein:

the introducing and varying comprise:

introducing a first alloy to a mold cavity via along a first flow path through a first port; and introducing a second alloy, differing in composition from the first alloy, to the mold cavity along a second flow path through a second port but not through the first port.

27. The method of claim 26 wherein:

the first flow path and second flow path partially overlap along a portion of a downsprue.

28. The method of claim 26 wherein:

the first flow path passes through a grain starter and the second flow path bypasses the grain starter.

29. The method of claim 26 wherein:

the first alloy has solidified to block the first port by the time the second alloy is introduced.

30. The method of claim 26 wherein:

the introducing and varying further comprise:

introducing a third alloy, differing in composition from the first alloy and second alloy, to the mold cavity along a third flow path through a third port but not through the first port or second port.

* * * * *